United States Patent [19]

Jones

[11] 4,150,179

[45] Apr. 17, 1979

[54] HOT DIP ALUMINIZING OF STEEL STRIP

[75] Inventor: Robert D. Jones, Cardiff, Wales

[73] Assignees: University College Cardiff, Cardiff; Coated Metals Limited, Swansea, Wales

[21] Appl. No.: 862,198

[22] Filed: Dec. 19, 1977

[51] Int. Cl.[2] ..... C23C 1/08

[52] U.S. Cl. ..... 427/405; 427/431; 427/432; 428/653; 428/654; 118/419

[58] Field of Search ..... 427/431, 405, 432, 433, 427/320, 321, 329; 428/653, 654; 204/38 A, 38 B

[56] References Cited

U.S. PATENT DOCUMENTS

| | | | |
|---|---|---|---|
| 1,741,388 | 12/1929 | Wehr et al. | 427/321 X |
| 2,111,826 | 3/1938 | Waltman et al. | 427/432 X |
| 2,135,388 | 11/1938 | Dellgren | 427/320 |
| 2,276,232 | 3/1942 | Gilbert | 427/432 X |
| 2,406,245 | 8/1946 | Oganowski et al. | 428/654 |
| 2,937,435 | 5/1960 | Brenner | 428/653 |
| 3,383,189 | 5/1968 | Sendzimir | 427/433 X |

OTHER PUBLICATIONS

Burns et al., Protective Coatings for Metals, Reinhold Pub. Corp. 1953, p. 261.

*Primary Examiner*—Ralph S. Kendall
*Attorney, Agent, or Firm*—Weingarten, Maxham & Schurgin

[57] ABSTRACT

This invention relates to a method and means for applying one or more coatings on to a substrate. The invention is particularly, but not exclusively, concerned with applying metal or alloy coatings on to metallic substrates in order to improve the formability and corrosion resistance of the substrates. Known coating processes include hot dip galvanizing, tinning and aluminizing, and in particular the method comprises feeding the substrate through a molten composition of a first coating material and subsequently feeding the so coated substrate into a molten composition of a second coating material whereby the coating of the second material is overlaid upon the coating of the first material.

4 Claims, 3 Drawing Figures

A SCHEMATIC DIAGRAM OF A DOUBLE DIP-ALUMINISING BATH

A SCHEMATIC DIAGRAM OF A DOUBLE DIP-ALUMINISING BATH

THE MICROSTRUCTURE OF TYPE 1 HOT DIP ALUMINISED STEEL. ×300

Figure 1:
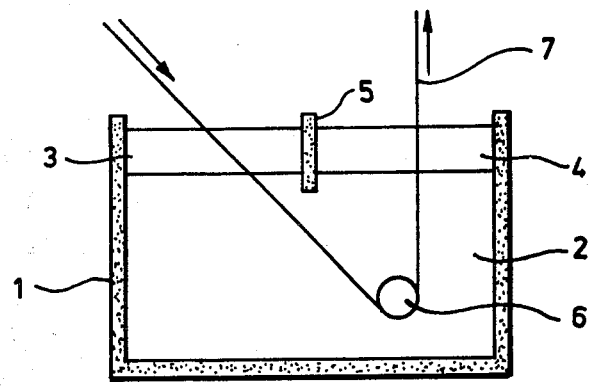

THE MICROSTRUCTURE OF TYPE 1 HOT DIP ALUMINISED STEEL AFTER AN ADDITIONAL 5 SECOND IMMERSION IN ALUMINIUM AT 700°C ×300

HOT DIP ALUMINIZING OF STEEL STRIP

This invention relates to a method and means for applying one or more coatings on to a substrate. The invention is particularly, but not exclusively, concerned with applying metal or alloy coatings on to metallic substrates in order to improve the formability and corrosion resistance of the substrates. Known coating processes include hot dip galvanising, tinning and aluminising.

In this specification, although specific reference will be made to the manufacture of aluminised steel strip, the underlying principles may be used for applying coatings other than aluminium to steel and other substrates.

Hot dip aluminised steel strip for corrosion and heat resistant applications is produced in two grades which are known commercially as Type 1 and Type 2. In the case of Type 1 the coating is an aluminium/5–12% silicon alloy whereas in the case of Type 2 the coating is pure aluminium. In practice the coating composition used in the production of Types 1 and 2 is normally contained in a bath which in use becomes contaminated with iron to an extent of about 3% during a hot dip campaign. The iron arises from solution of the ferrous processing hardware immersed in the coating composition.

It is generally acknowledged that Type 1 coated steel is more formable but less corrosion resistant than Type 2 coated steel. By formability in this specification is meant the ability of the coating to deform with the steel substrate whilst remaining integral with the substrate. A cross section taken through a hot dipped aluminised steel substrate indicates an aluminium rich outer coating, a layer comprising an iron aluminium intermetallic compound, which is generally referred to as an alloy layer, and finally the substrate. During deformation the alloy layer behaves like a typical low ductility metallic compound and tends to crack and so reduce the degree of cohesion between the outer coating and the substrate. The forming properties can, however, be improved by reducing the thickness of the alloy layer as much as possible and we have found that the effect of silicon additions to aluminium in the coating composition is markedly to reduce the thickness of the alloy layer developed during a given time of immersion at a predetermined temperature. However, the presence of appreciable quantities of silicon in Type 1 coatings tends to impair the corrosion resistance by increasing the number of heterogeneities in the coatings at which corrosion attack can occur. On the other hand, the relatively more pure Type 2 coatings are superior in respect of corrosion resistance.

According to the present invention there is provided a method of coating a substrate comprising feeding the substrate through a molten composition of a first coating material and subsequently feeding the so coated substrate into a molten composition of a second coating material whereby the coating of the second material is overlaid upon the coating of the first material. In order to prevent contact between the substrate bearing the first coating and the ambient atmosphere, the so coated substrate is preferably passed from one coating composition to another via an inert atmosphere or environment which may be liquid or gaseous. Passage through an inert atmosphere is advantageous in that surface oxidation of the first coating is inhibited, if not prevented, prior to application of the second coating. The first and second coating compositions are preferably floatingly supported on a layer of molten material which is inert relative to the two coating compositions which are separated from one another by a partition. Where it is desired to aluminise a steel substrate, for example a steel strip, the first and second coating compositions are preferably aluminium/silicon alloy containing between 5 and 12% silicon and aluminium respectively.

One form of apparatus for carrying out the present invention is shown in FIG. 1 comprising a bath 1 containing a quantity 2 of molten lead. Floatingly supported on the molten lead are quantities of an aluminium/silicon melt 3 and an aluminium melt 4. The melts 3 and 4 are, as shown, separated from one another by a divider 5. A steel roll 6 is mounted in the bath 1 in the position shown and steel substrate, in the form of a strip 7, is firstly fed through the aluminium/silicon melt into the molten lead around the steel roll 6 and exits from the bath through the aluminium melt 4. The immersed steel roll 6 serves to change the direction of travel of the strip and allow a double coating to be applied to the strip in a single operation. An added advantage of the apparatus is that the steel roll 6 is protected by the lead melt from the dissolution effect of molten aluminium and consequently it is expected that the roll will have an increased service life. Similarly, the molten aluminium on the exit side will be subject to less iron contamination and as such is expected to produce a more corrosion resistant coating on the steel strip.

Figure 2:
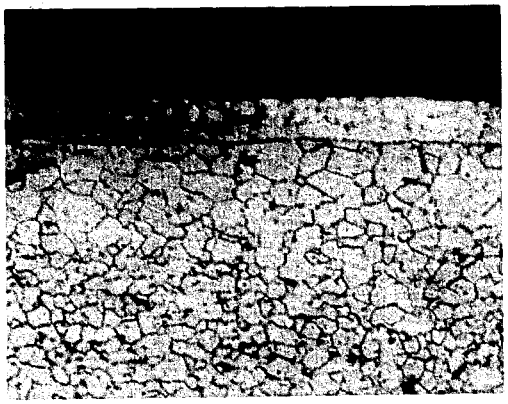
Figure 3:
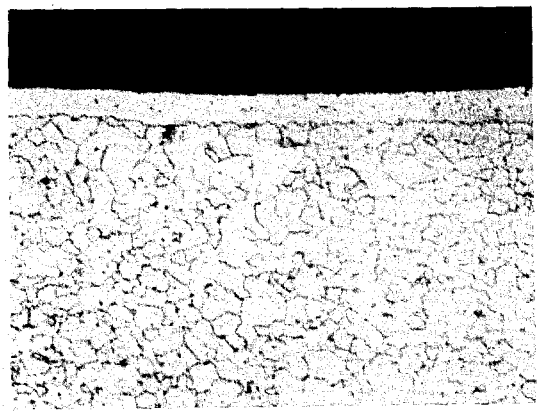

Our experiments using the above apparatus for applying a double coating on to a steel substrate have shown, after a 5 second immersion in a pure aluminium bath at 700° C, a specimen previously treated in an aluminium/silicon bath to produce a 6–8 μm thick alloy layer will experience restricted alloy layer growth to a thickness of 8–10 μm i.e. only 2 μm approximately more than the initial alloy layer thickness. An uncoated steel specimen dipped into a pure aluminium bath at 700° C will develop an alloy layer 20 μm thick after 5 seconds. Thus a first or preliminary alloy coating produced in an aluminium/silicon bath appears to act very strongly to restrict the rate of further growth in any subsequent coating step. FIG. 2 shows the microstructure of hot dip aluminised steel after prior treatment in an aluminium/silicon bath and FIG. 3 shows the microstructure of this material after it has been further dipped for 5 seconds in aluminium at 700° C. The thicker aluminium coating of FIG. 3 reveals an absence of the eutectic silicon network seen in FIG. 2.

What we claim is:

1. A method of coating a steel substrate comprising the steps of:

floating a first composition comprising aluminum/silicon alloy containing between 5 and 12 wt.% silicon on a bath of molten material;

floating a second composition comprising aluminum on said bath of molten material, said molten material being inert relative to said first and second compositions;

separating said first and second compositions on said bath of molten material; and feeding the substrate sequentially through said first composition, then directly through said molten material and then directly through said second composition;

whereby the coating of the second composition is overlaid upon the coating of the first composition on said substrate.

2. A method according to claim 1 wherein coating is carried out at a temperature within the range 600–800° C.

3. A method according to claim 1 wherein the coating of the first composition has a thickness of between 6 and 8 μm and the coating of the second composition has a thickness of up to 10 μm.

4. A method according to claim 3 wherein the coating of the second composition has a thickness of between 8 and 10 μm.

* * * * *